US007356966B2

(12) United States Patent
Burke

(10) Patent No.: US 7,356,966 B2
(45) **Date of Patent: *Apr. 15, 2008**

(54) RAILROAD GRADE CROSSING ASSEMBLY

(76) Inventor: Thomas J. Burke, 5 Matheson Rd., Whitehouse Station, NJ (US) 08889

( * ) Notice: Subject to any disclaimer, the term of this patent is extended or adjusted under 35 U.S.C. 154(b) by 326 days.

This patent is subject to a terminal disclaimer.

(21) Appl. No.: 10/891,746

(22) Filed: Jul. 15, 2004

(65) Prior Publication Data

US 2005/0060936 A1 Mar. 24, 2005

Related U.S. Application Data

(63) Continuation-in-part of application No. 10/623,792, filed on Jul. 21, 2003, which is a continuation-in-part of application No. 09/811,998, filed on Mar. 19, 2001, now Pat. No. 6,618,993.

(51) Int. Cl.
*E01F 13/00* (2006.01)

(52) U.S. Cl. ..... 49/49

(58) Field of Classification Search ..... 49/26, 49/28, 49, 25; 246/125, 261, 272
See application file for complete search history.

(56) References Cited

U.S. PATENT DOCUMENTS

| | | | | |
|---|---|---|---|---|
| 3,176,126 | A * | 3/1965 | Vineall | 246/125 |
| 4,658,543 | A | 4/1987 | Carr | |
| 4,666,108 | A | 5/1987 | Fox | |
| 4,894,952 | A * | 1/1990 | Trett et al. | 49/25 |
| 4,897,960 | A | 2/1990 | Barvinek et al. | |
| 5,299,386 | A | 4/1994 | Naegelli et al. | |
| 5,331,312 | A | 7/1994 | Kudoh | |
| 5,671,563 | A | 9/1997 | Marcum | |
| 6,119,399 | A | 9/2000 | McCain et al. | |
| 6,189,839 | B1 | 2/2001 | Lemieux | |
| 6,195,020 | B1 | 2/2001 | Brodeur, Sr. et al. | |
| 6,205,710 | B1 * | 3/2001 | Busse | 49/27 |
| 6,267,332 | B1 * | 7/2001 | Almblad | 246/294 |
| 6,279,687 | B1 * | 8/2001 | Pustelniak et al. | 187/317 |
| 6,340,139 | B1 | 1/2002 | Hilleary | |

* cited by examiner

*Primary Examiner*—Jerry Redman

(57) ABSTRACT

An articulate railroad grade crossing assembly. In a preferred embodiment, the crossing assembly has an adjustable reach so that it can be adjusted to completely or partially close roadways of various sizes. In another preferred embodiment, the assembly includes one or more sensors for detecting the presence of people and/or objects in the crossing area so that the assembly can automatically respond to such presence.

21 Claims, 10 Drawing Sheets

RAILROAD GRADE CROSSING ASSEMBLY

CROSS-REFERENCE TO RELATED APPLICATION

This application is a continuation-in-part of co-pending U.S. patent application Ser. No. 10/623,792, which was filed on Jul. 21, 2003, and which is a continuation-in-part of U.S. patent application Ser. No. 09/811,998 (now U.S. Pat. No. 6,618,993), which was filed on Mar. 19, 2001. Both application Ser. Nos. 10/623,792 and 09/811,998 are hereby incorporated by reference.

FIELD OF THE INVENTION

The present invention relates to an improved railroad grade crossing assembly, and more particularly to an articulated railroad grade crossing assembly that includes monitoring and control features to permit more intelligent operation.

BACKGROUND OF THE INVENTION

Prior railroad gates have a notable drawback, their lack of an intelligent monitoring and control capability. That is, prior gates provide for little more than the most basic monitoring and control functions. Monitoring the gates is generally achieved through visual inspection, and controlling them involves switching between the "up" and "down" positions. In particular, prior gates do not provide for remote monitoring of the gate and/or crossing, and do not provide for programmable control of the gate.

Moreover, railroad grade crossing assemblies that are currently in use only close the road in the direction of traffic to within one foot of the center line. Therefore, the present railroad gates allow for a vehicle operator to make an S turn across the track thereby creating the potential for disaster. As a result, the railroads are currently under pressure to put in additional gates to completely close vehicle access to the tracks. It has therefore been found desirable to provide a railroad gate which allows a gate crossing to be completely closed prior to the arrival of a train.

A drawback in designing a railroad gate which completely closes the gate crossing is that is must comply with time requirement for closing a railroad crossing which are determined by federal, state and municipal governments. It is therefore further desirable to provide a railroad gate which not only completely closes the gate crossing but also complies with the time requirements for closing a railroad crossing which are determined by federal, state and municipal governments.

Another obstacle to designing a railroad gate that completely closes the gate crossing is the length/height of such a gate. The longer gate arm required to completely close the crossing results in a taller gate when the gate is in the "up" position, thereby making the gate more likely to suffer wind damage and to interfere with overhead obstructions such as power lines. Accordingly, there is a desire to design a gate that completely closes the crossing yet remains relatively short when in the "up" position.

Currently, the installation of a single new railroad gate at a railroad crossing can cost upwards of $14,000, or $28,000 to $30,000 per crossing. With the over 56000 railroad crossings just in the United States, in order to attract the railroads to install any new railroad gate, that railroad gate must be relatively inexpensive. As a result, in order to minimize costs, it has been found desirable to provide a gate assembly which is adaptable to an existing railroad stanchion and light assembly. There are also railroad crossings which are in remote areas and have no power supply. As a result, in order to properly protect these crossings, it has been found desirable to provide a gate assembly which is self contained and provides its own power.

It is further noted that in many jurisdictions it is not necessary for a train passing a railroad crossing to blow its whistle when the crossing is completely closed. Thus, gate assemblies that completely close the crossing are even more desirable in such jurisdictions.

OBJECTS OF THE INVENTION

In view of the drawbacks of prior railroad grade crossing assemblies, it is an object of the present invention to provide a railroad grade crossing assembly having intelligent monitoring and control operability.

It is a further object of the invention to provide an improved railroad grade crossing assembly which completely closes the gate crossing prior to arrival of a train.

It is yet another object of the invention to provide a railroad grade crossing assembly which completely closes the gate crossing prior to arrival of a train and which has intelligent monitoring and control operability.

It is still another object of this invention to provide a railroad grade crossing assembly which not only allows a gate crossing to be completely closed but also is adaptable to an existing stanchion and light assembly.

It is a further object of the present invention to provide a railroad grade crossing assembly which completely closes the gate crossing and complies with the time requirements for closing a railroad crossing which are mandated by federal, state and municipal governments.

It is yet another object of the present invention to provide a relatively inexpensive railroad grade crossing assembly capable of completely closing the gate crossing.

It is still another object of the invention to provide a railroad grade crossing assembly which can be readily attached to the arm of an existing railroad grade crossing system.

It is a further object of the invention to provide a self contained railroad grade crossing assembly which provides its own power.

It is yet another object of the present invention to provide a railroad grade crossing assembly that has an adaptable reach such that it can be adjusted to completely or partially close roadways of various sizes.

It is still another object of the invention to provide a railroad grade crossing assembly that can detect the presence of people and/or objects in the crossing area and automatically respond to such detection.

Various other objects, advantages and features of the present invention will become readily apparent from the ensuing detailed description and the novel features will be particularly pointed out in the appended claims.

SUMMARY OF THE INVENTION

An articulate railroad grade crossing assembly. In a preferred embodiment, the crossing assembly has an adjustable reach so that it can be adjusted to completely or partially close roadways of various sizes. In another preferred embodiment, the assembly includes one or more sensors for detecting the presence of people and/or objects in the crossing area so that the assembly can automatically respond to such presence.

BRIEF DESCRIPTION OF THE DRAWINGS

The following detailed description given by way of example, but not intended to limit the invention solely to the specific embodiments described, may best be understood in conjunction with the accompanying drawings wherein like reference numerals denote like elements and parts, in which.

DETAILED DESCRIPTION OF A PREFERRED EMBODIMENT OF THE INVENTION

This invention relates to a railroad grade crossing assembly which restricts vehicles from crossing a railroad crossing prior to the arrival of a train and which includes programmable control and/or remote monitoring features. In a preferred embodiment, the railroad grade crossing assembly completely closes the gate crossing to vehicle access prior to arrival of a train. For purposes of facilitating description of the inventive railroad grade crossing assembly, the invention will initially be described with emphasis on the complete closure feature, with description of the monitoring and control features to follow.

The railroad grade crossing assembly of the present invention can be adapted to existing railroad stanchion, arm and/or light assemblies which previously included gate assemblies which only partially closed the railroad crossing. The railroad grade crossing assembly of the present invention includes an improved gate assembly adaptable to the existing stanchion, arm and/or light assembly. This gate assembly is comprised of a two piece telescopic arm (formed of first and second arm members) assembly and a gravity actuated support leg. Upon initial signal or sensing of a train approaching, the arm assembly falls to a generally horizontal position with the gravity operated support leg falling to a generally vertical position impinging upon the ground surface to support the arm Thereafter, but well prior to the train arriving at the crossing, the second arm member of the gate assembly extends outwardly from the first arm member to completely close the railroad crossing.

In another embodiment of the present invention the railroad grade crossing assembly includes a gate means movable between a generally horizontal retracted position to permit vehicle access across a railroad crossing and a generally extended horizontal position for blocking vehicle access across a railroad crossing, the gate means includes a telescopic arm for completely closing the railroad crossing, a first and second stanchions. The telescopic arm is extendable and retractable from the gate means wherein upon a pre-set interval prior to a train arriving at a railroad crossing, the gate means extends from its said generally retracted position to a generally extended position extending from said first stanchion to said second stanchion, to completely close the railroad crossing. The railroad grade crossing assembly also includes a battery to power the gate means and a solar panel to recharge the battery. A low battery indicator may also be includes to indicate that said battery has a low voltage. A listening device is provided to detect the sound of an oncoming train and activate the gate means, and a sensor is provided to sense when a train has passed and thereby cause the gate means to retract.

Figure 1:
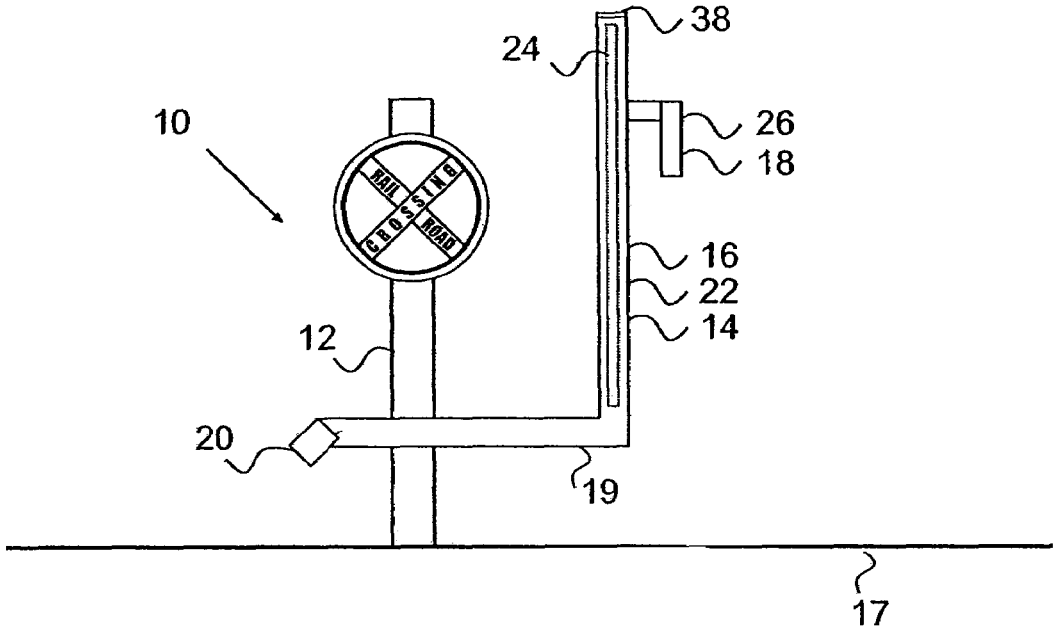
FIG. 1 is a front elevational view of a preferred embodiment of a railroad grade crossing assembly in accordance with the present invention in with the arm assembly in its generally upright position prior to arrival of a train.
Figure 2:
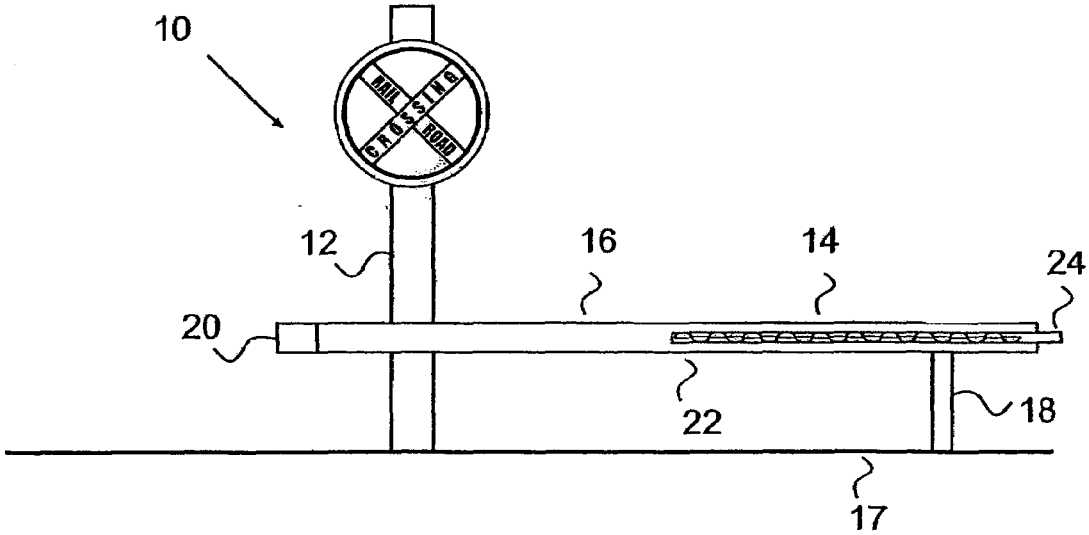
FIG. 2 is a front elevational view of the railroad grade crossing assembly assembly of FIG. 1 in a first train approaching position whereupon the arm assembly thereof is moved into a first generally horizontal position and the support leg thereof falls into a generally upright position supporting the arm assembly.
Figure 3:
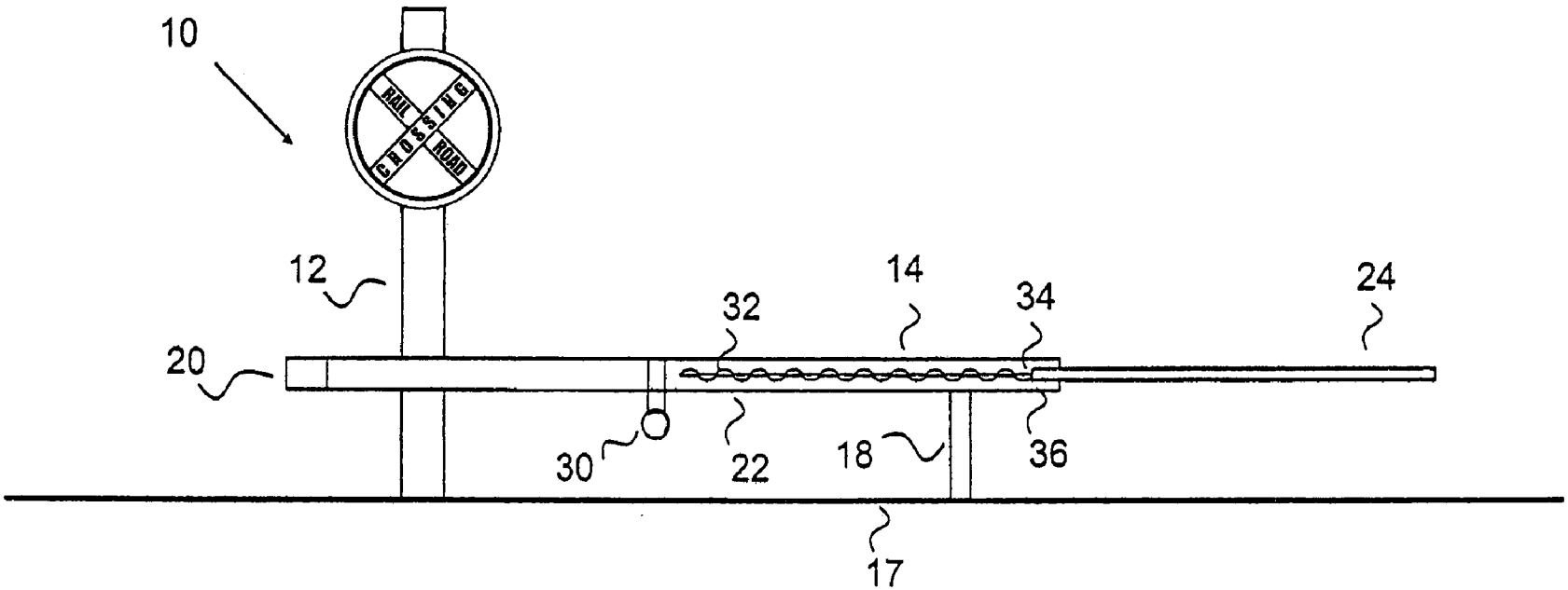
FIG. 3 is a front elevational view of the railroad grade crossing assembly of FIG. 1 in a second train approaching position whereupon the telescopic arm assembly extends outwardly such that the arm assembly completely closes the gate crossing prior to arrival of the train.

Referring now to FIGS. 1 through 3 of the drawings, a first embodiment of a railroad grade crossing assembly in accordance with the teachings of the present invention is illustrated. This railroad grade crossing assembly 10 of the present invention can be adapted to an existing stanchion and light assembly 12 which included a gate assembly (not shown) which only partially closed the railroad crossing.

Here, the railroad grade crossing assembly 10 of the present invention is formed of an improved gate assembly 14 which is connectable to the existing stanchion and light assembly 12. As is shown in FIGS. 1 through 3, the gate assembly 14 includes a two piece telescopic arm assembly 16 and a gravity actuated support leg 18. This arm assembly is movable between a generally upright position (see FIG. 1) and a generally horizontal position (see FIGS. 2 and 3). In the generally upright position of the arm assembly 14 of FIG. 1, the base of the arm assembly 19 is held in a generally horizontal orientation by a counterweight 20.

This telescopic arm assembly includes a first arm member 22 and a second arm member 24 extendable and retractable from the first arm member 22. In accordance with one of the general objects of the present invention, the operation of the gate assembly 16 complies with federal, state and local regulations regarding time requirements for closing a railroad crossing. As is shown in FIG. 2, upon a first pre-set interval prior to a train arriving at the railroad crossing, the gate assembly 14 falls from its generally upright position of FIG. 1 to a generally horizontal position of FIG. 2 and the support leg 18 falls by gravity into a generally vertical position impinging on the ground surface 17 to thereby support the arm member 14. Preferably, support leg 18 includes a gas shock absorber to dampen the shock experienced upon impingement on the surface.

Upon a second pre-set interval prior to a train arriving at the railroad crossing, the second arm member 24 of the gate assembly 14 extends outwardly from the first arm member 22 to completely close the railroad crossing (see FIG. 3). After the train has passed the railroad crossing, the second arm member 24 retracts with respect to the first arm member 22 so as to be in the position of FIG. 2. Thereafter, the gate assembly 14 is moved from its generally horizontal position of FIG. 2 to its generally upright position of FIG. 1.

FIG. 3 best illustrates the first embodiment actuating mechanism for extending and retracting the second arm 24 with respect to the first arm member 22 of the telescopic arm mechanism 14 for completely closing and opening the railroad crossing to vehicle access. This actuating mechanism includes a DC motor with right angle device 30 which turns a threaded rod 32 which is mated with a compatible nut 34 attached to an end 36 of the second arm member 24 so as to extend and retract the second arm member 24 depending upon the rotation of the DC motor 30.

A second embodiment of a railroad grade crossing assembly according to the present invention is illustrated in FIGS. 4-7.

Figure 4:
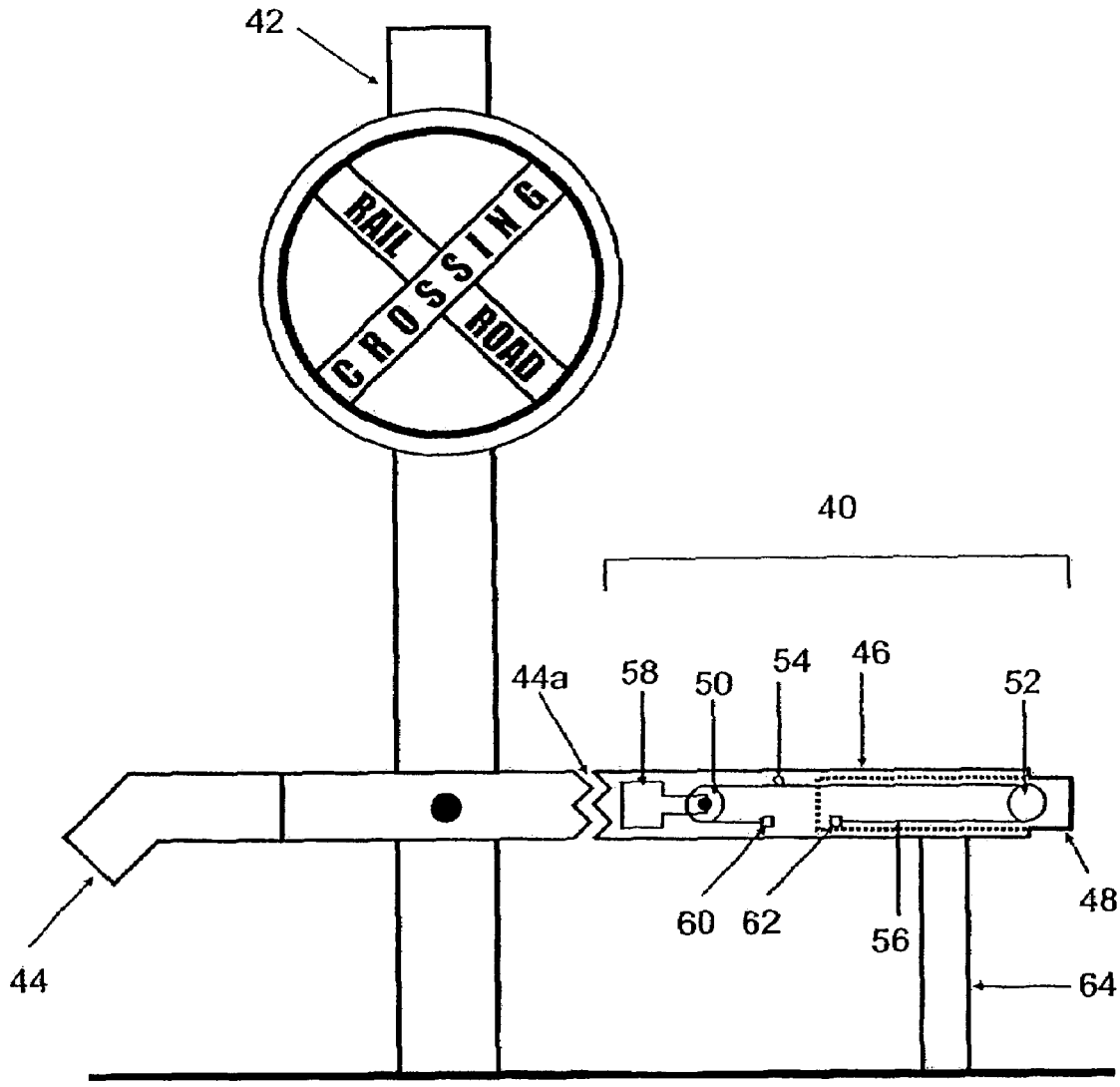
FIG. 4 is a plan view of a railroad grade crossing assembly in accordance with a second embodiment of the invention.

FIG. 4 is a plan view showing a railroad grade crossing assembly 40 according to the second embodiment, and showing how the railroad grade crossing assembly according to the second embodiment can be attached to a preexisting stanchion 42 and arm assembly 44. As can be seen from the figure, the crossing assembly includes an outer gate 46 and an inner (or "telescoping") gate 48. The assembly of the invention is attached to a preexisting stanchion 42 and arm 44 by cutting arm 44 as indicated at position 44*a* and then splicing outer gate 46 to the arm.

More specifically, the crossing assembly of the invention can be employed at existing railroad crossings by laying assembly 40 across the roadway where it is to be used such that the assembly in its extended state would completely close the roadway at the location of the existing stanchion. Once the assembly is laid out in this fashion, one can determine the appropriate positions at which to cut the existing arm 44 and/or outer gate 46 so that following splicing of the remaining arm portion and outer gate the resulting railroad crossing system will have the correct extended length for completely closing off the roadway. Employing the assembly of the invention in this manner, facilitates the supply of assemblies by allowing the manufacture of standard size assemblies (e.g. "2 lane" and "4 lane") which can then be trimmed to the precise length required.

In order to effect telescoping operation of inner gate 48, assembly 40 includes three pulleys 50, 52 and 54, a cable 56 which operates in conjunction with the pulleys, a motor 58 and two tension fasteners 60 and 62. In addition, the assembly includes a support leg 64 like leg 18 of FIGS. 1-3. In order to provide durability and the desired operating properties it is preferred that the cable be a vinyl coated steel cable of aircraft quality.

When extension of the inner gate is desired, the motor (e.g. a DC electric motor) produces a counter clockwise turning force on pulley 50 which is a deep V-type pulley. Upon application of the counter clockwise force pulley 50 exerts a longitudinal force on cable 56 (right to left in the figure). The force exerted on the cable is, in turn, transferred via pulled 52 onto tension fastener 62 (as a left to right force in the figure). Since pulley 50 is coupled to the outer gate which is secured to stanchion 42, and pulley 52 and tension coupling 62 are coupled to the inner gate which is free to extend out of the outer gate, the resulting force on tension coupling 62 moves the inner gate into an extended position.

Pulley 54 is an idling pulley which contacts cable 56 and is coupled to a switch (not shown) that triggers a reverse telescoping mechanism (not shown in FIG. 4) in the event the inner gate encounters an obstruction as it telescopes out of the outer gate. The pulley 54 is free to move in a vertical direction and is spring loaded with a downward bias such that its initial vertical position is determined according to the spring force and the vertical force which is exerted on the pulley due to the tension in cable 56. If inner gate 48 is obstructed from its extension while motor 58 is exerting a counter clockwise force on pulley 50, the tension in cable 56 increases, thereby moving pulley 54 upward and triggering the switch which activates the reversing mechanism. In this manner damage to the assembly and to objects in the path of the telescoping inner gate (e.g. an automobile) can be minimized.

Figure 5:
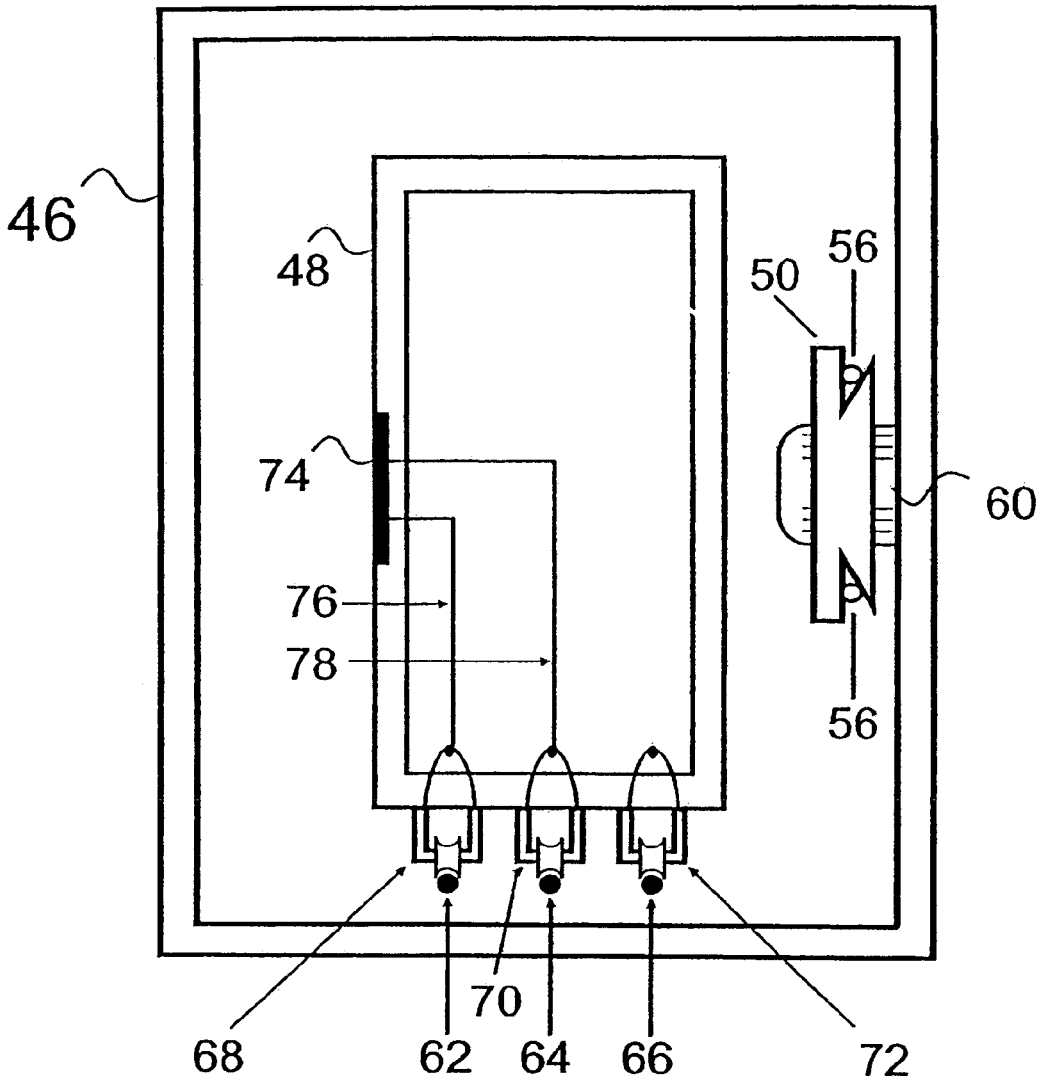
FIG. 5 is a cross-section view of the assembly shown in FIG. 4.

FIG. 5 is a cross-section view of the assembly shown in FIG. 4. For simplicity of presentation, the motor 58 of FIG. 4 is not shown in FIG. 6, but rather deep V pulley 50 is simply shown as being fixed in a rotatable manner to the outer gate 46 via an axle having a spline 60. As can be seen from FIG. 6, tension on cable 56 acts to wedge the cable in the V-shaped rim of pulley 50, thereby facilitating the transfer of force on the pulley into longitudinal force in the cable.

Along the inner surface of the outer gate are situated a multiple of electrically conducting rods 62, 64 and 66, preferably ⅛" diameter. Although three conducting rods are shown in the figure any number or rods may be used. In any event the rods serve a dual purpose, they aid in guiding the inner gate during telescoping and retracting operation and they provide electrical current and grounding along the length of the assembly. The rods are accessed by the inner gate via a multiple of conducting wheel arrangements 68-72, and in the illustrated embodiment the rods and wheel arrangements provide power to lights positioned on the inner gate. In the figure, a flush mounted inner gate light 74 is shown electrically connected to the rods 62 and 64 via couplings 76 and 78, respectively.

Figure 6:
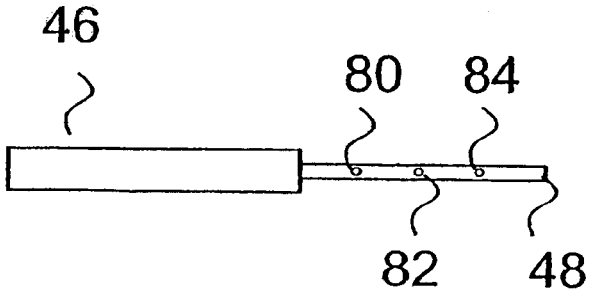
FIG. 6 is shows the gate assembly of the second embodiment in an extended position.

FIG. 6 shows a gate assembly of the invention in an extended position. The inner gate of the figure includes three flush mounted lights 80, 82 and 84, and in a preferred configuration lights 82 and 84 flash when the inner gate is extended, while light 80 remains on constantly when the inner gate is extended. Such configuration can be achieved by supplying a constant current signal through one of the rods, a flashing current signal through another one of the rods, and a ground signal through the remaining rod. Furthermore, such signals can be readily supplied to the rods via the couplings that typically exist at current railroad crossings. Thus, facilitating the provision of warning light indications with the assembly of the present invention.

Moreover, it should be noted that bulbs with bayonet type connectors may be used in/as the inner gate lights. Such bulbs are inserted into a socket by simply placing the connector end of the bulb into the socket and twisting less than a full turn. The flush portion of the lights is preferably made of a translucent bulletproof material such as bulletproof glass or plastic. The bulletproof material serves to protect the lights from vandals and harsh environmental conditions. As an alternative using bulletproof material to form a part of the lights themselves, a bulletproof translucent covering is provided for the lights.

Having described the embodiments of FIGS. 1-3 and FIGS. 4-7, it should be noted that in any of the embodiments extension of the inner gate may be triggered through circuitry provided in current railroad crossing systems, through a leveling switch which initiates extension when the gate arm becomes substantially horizontal in relation to the road, through a PLC (Programmable Logic Controller), or through some combination of the aforementioned techniques.

Further, in order to keep rain, snow, and ice, etc. from the gate assembly when the gate assembly is in its generally upright position (as shown for example in FIG. 1) the first arm member 22 or outer gate includes a waterproof covering member, such as a waterproof boot (e.g. boot 38 of FIG. 1) at an end thereof.

Figure 7:
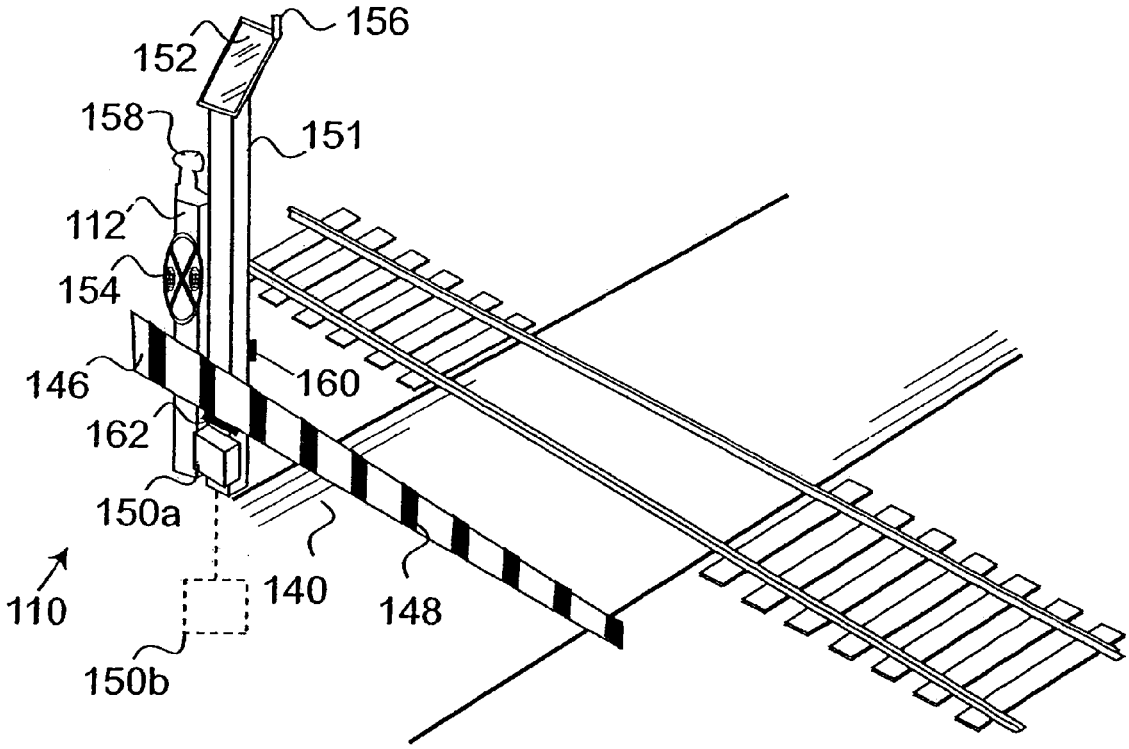
FIG. 7 is shows the gate assembly of the third embodiment of the present invention.

Referring now to FIG. 7 of the drawings, a third embodiment of a railroad grade crossing assembly in accordance with the teachings of the present invention is illustrated. This railroad gate crossing assembly 110 of the present invention is self contained and can be adapted to an existing stanchion and light assembly 112 which may or may not included a gate assembly (not shown) which only partially closed the railroad crossing. The assembly provides its own power supply.

Here, the railroad grade crossing assembly 110 of the present invention is formed of an improved gate assembly 140 which is connectable to the existing stanchion 112. As can be seen from the figure, the crossing assembly includes an outer gate 146 and an inner (or "telescoping") gate 148. The assembly of the invention is attached to a preexisting stanchion 112.

More specifically, the crossing assembly of the invention can be employed at existing railroad crossings by laying assembly 140 across the roadway where it is to be used such that the assembly in its extended state would completely close the roadway at the location of the existing stanchion 112.

This telescopic arm assembly includes a first arm member 146 and a second arm member 148 which is extendable and retractable from the first arm member 146. In order to effect telescoping operation of inner gate 148, the internal workings of assembly 140 operates as assembly 40 described above.

A second post 151 is added on the same side of the roadway as the existing stanchion 112 to receive the inner gate 148. Mounted on the second post 151 is a battery enclosure 150*a* containing a battery. The battery may also be mounted under ground as in battery enclosure 150*b*. Attached to the top of second post 151 is a solar battery charger 152 for charging the battery contained in battery enclosures 150*a* and 150*b*. Lights 154 may be added to the existing stanchion 112 and powered by the battery. A low voltage indicator is mounted on the second post 151 for indicating to passing trains that the voltage of the battery is low. A listening device 158 is mounted on top of the existing stanchion and an electronic eye sensor 160 is mounted near the vertical center of the existing stanchion 112.

Figure 8:
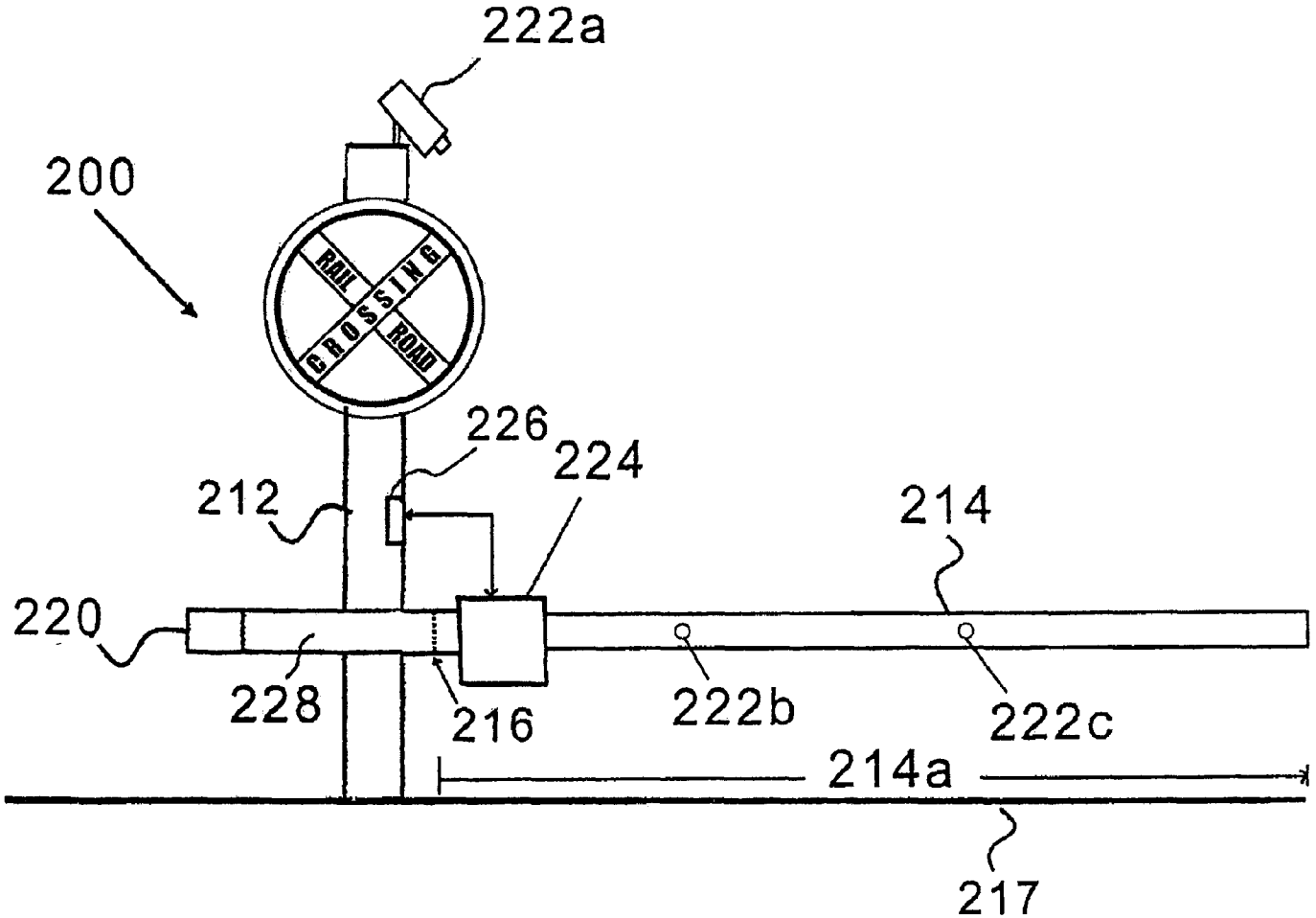
FIG. 8 shows a gate assembly according to a fourth embodiment of the present invention.

When a train is approaching and extension of the inner gate 148 is desired, the oncoming train signals the listening device 158 by sounding the train's whistle. When this occurs, the lights 154 begin to flash, and a motor (not shown) moves the inner gate 148 into an extended position where it contacts the second post 151 and rests on ledge 162 as shown in FIG. 7. The Outer Gate 146 does not move as in the previous embodiments, but remains, at all times, parallel to both the ground and the train tracks as shown in FIG. 8.

This action completely closes the railroad crossing. After the electric eye 160 has determined that the train has passed the railroad crossing, the inner gate 148 retracts with respect to the outer gate 146. If the voltage of the battery ever becomes low, warning light 156 is illuminated when the inner gate 148 is extended, to notify the passing train.

Accordingly, in accordance with one of the general objects of the present invention, an improved railroad grade crossing assembly for completely closing a railroad gate crossing prior to arrival of a train has been provided. In addition, this railroad grade crossing assembly of the present invention is adaptable to the existing stanchion, arm and/or light assemblies that are presently in place. Moreover, since the arm assembly of the present invention is readily connectable to the existing stanchion, arm and/or light assembly, this improved railroad gate assembly is relatively inexpensive.

Having described the inventive railroad grade crossing assembly in the context of its complete closure feature, the assembly will now be described with emphasis on its monitoring and control features.

FIG. 8 shows a railroad grade crossing assembly 200. The crossing assembly includes an arm assembly 214 and a stanchion and light assembly 212. The arm assembly is movable between a generally upright position in which the arm assembly is generally perpendicular to ground surface 217, and a generally horizontal position in which the arm assembly is generally parallel to ground surface 217. The movement of the arm assembly between positions is facilitated by a counterweight 220. The crossing assembly further includes video cameras 222*a*, 222*b* and 222*c*, and an electronics module 224. The cameras interface with the electronics module through couplings (not show) which may take the form of coaxial cables, twisted pair wires, fiber optic cables, wireless links, or any other connection suitable for video transmission. The electronics module is coupled to an interface box 226 which provides access to the standard railroad gate signals/wiring.

In a preferred implementation, crossing assembly 200 is formed using a pre-existing stanchion and light assembly and an pre-existing arm base 228. More specifically, stanchion and light assembly 212 and arm base 228 are part of a pre-existing crossing assembly, the remaining portion of the existing arm having been cut off at a position 216, and a new arm subassembly 214*a* having been attached to the pre-existing base at position 216. The interface box 226 may be part of the pre-existing stanchion, or it may be added along with the new arm subassembly. Similarly, counterweight 220 may be part of the pre-existing stanchion, or it may be added along with the new arm subassembly. Alternatively, the appropriate counterweight may be set by adding or subtracting weight to/from a pre-existing counterweight. Video camera 222*a* may also be added along with the new subassembly.

In any event, the electronics systems included in the FIG. 8 embodiment allow for intelligent operation of the crossing assembly. Video cameras 222*b* and 222*c* allow for visual monitoring of traffic approaching and leaving the gate. Additional cameras could also be placed on the opposing side of subassembly 214 to allow for visual monitoring from an opposite perspective. Camera 222*a* provides another perspective on the crossing from atop the stanchion. As an option, bulletproof coverings could be provided for the cameras and/or camera lenses in order to make the cameras more robust. As another option, one or more of the cameras may be an infrared camera that is capable of generating images during the evening hours.

Video generated by the cameras could be used to analyze the cause of any accidents occurring at the gate, or to generate license plate pictures of vehicles who's drivers violate traffic laws near the gate. Preferably, the video from each of the cameras is communicated to the electronics module and is either stored in a memory within the module or transmitted by the module to a remote monitoring station.

The electronics module also serves to monitor gate usage and gate power status through the interface 226. Digital signals indicative of the gate usage and power status are generated and, as in the case of the video, may be stored in a memory within the electronics module or communicated to a remote monitoring station. The electronics module will be discussed in more detail with regard to the FIG. 9 embodiment.

Figure 9:
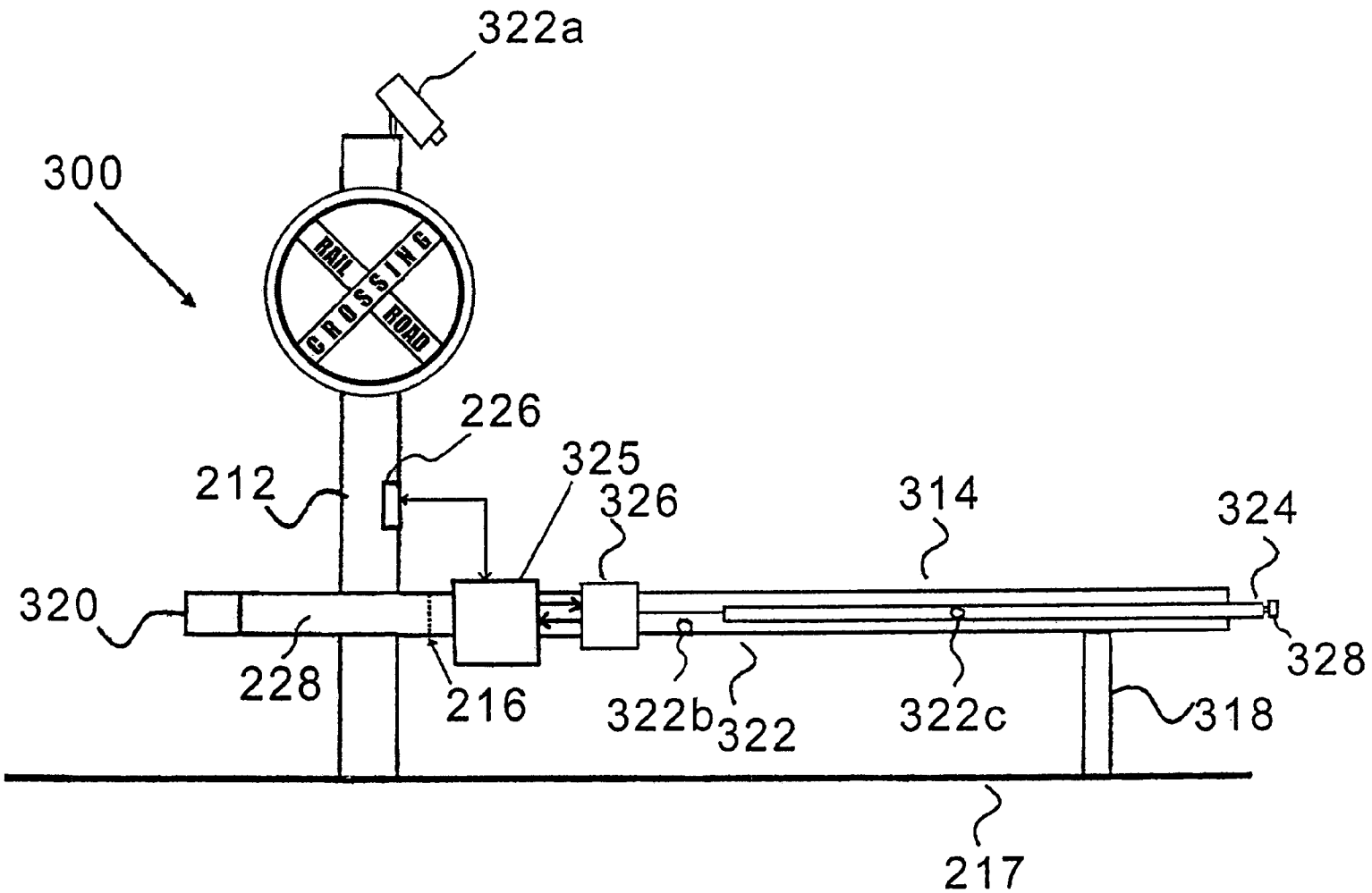
FIG. 9 shows a gate assembly according to a fifth embodiment of the present invention.

FIG. 9 depicts a railroad grade crossing assembly 300 that incorporates both the complete closure and monitoring/control aspects of the invention. The FIG. 9 embodiment includes a telescopic arm assembly 314 mounted on pre-existing arm base 228 which is, in turn, mounted on pre-existing and stanchion and light assembly 212. The telescopic arm assembly includes a first arm member 322, a second arm member 324 extendable and retractable from the first arm member 322, a motor 326 for actuating extension and retraction of arm member 324, an electronics module 325 for monitoring and controlling motor 326 and for monitoring and controlling the overall gate assembly, video cameras 322*b* and 322*c*, a bump switch 328, and a gravity actuated support leg 318. The arm assembly is movable between a generally upright position and a generally horizontal position.

The motor shown in FIG. 9 is operable to extend and retract arm member 324 via any of the mechanisms previously discussed. However, in the FIG. 9 embodiment the motor is further operable to respond to control signals received from electronics module 325 and to transmit status signals to the electronics module. It should be noted that, while the motor and electronics module have been shown as two separate units, they may be incorporated into a single unit.

Figure 10:
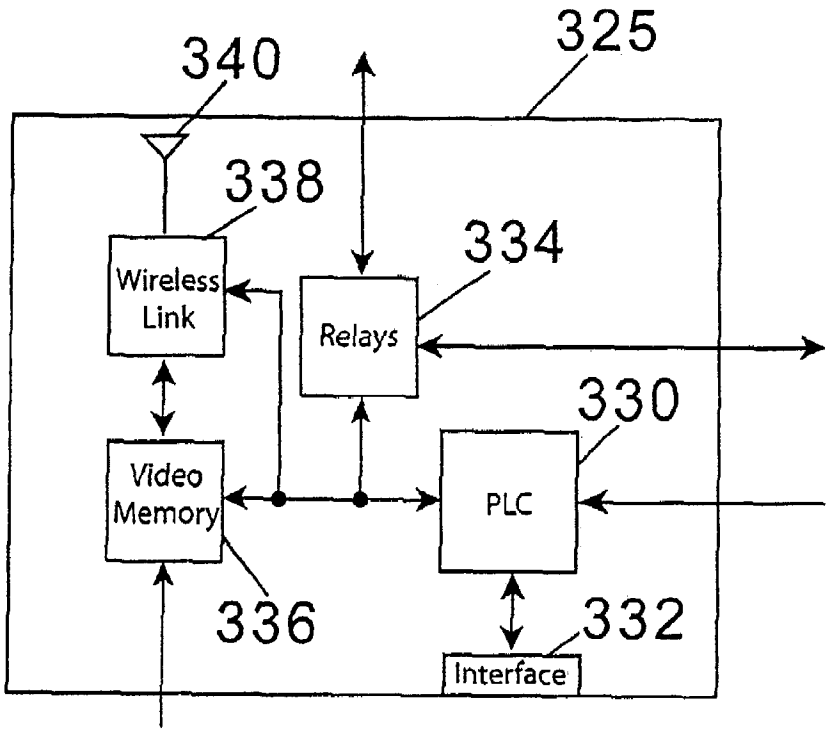
FIG. 10 shows an internal configuration of the electronics module depicted in FIG. 9.

An internal configuration of electronics module 325 is shown in FIG. 10. As can be seen from FIG. 10, the module includes a programmable logic controller (PLC) 330, an interface 332 through which the PLC can be coupled to an external device, one or more relays 334 which are controlled by the PLC, a video memory 336 for storing video received from the gate assembly cameras, a wireless link 338 for providing wireless communication to/from the PLC and video memory, and an antenna 340 for carrying out wireless link communications.

The PLC is programmed according to the desired gate operation parameters. One of the parameters that is set through the PLC is the time at which telescoping operation of the gate is to begin. For example, the PLC could be programmed to begin the telescoping operation when the gate has moved more than 45 degrees away from its vertical position toward its horizontal position. Other parameters that can be set determine how the gate reacts to activation of the bump switch. When the extending telescopic arm encounters an obstruction the bump switch is triggered, causing the extending arm to retract. The PLC may be programmed to cause the arm to retract and stay in the retracted position after a single activation of the bump switch. Or, the PLC may be programmed to cause the arm to retract after the bump switch is activated, and then try extend again after a 5 second delay; whereby, after 3 unsuccessful attempts at extending the arm the arm is kept in the retracted position. Still other parameters that may be set determine the gate's reaction to electronic failures. For instance, the PLC is programmed to maintain the telescopic arm in the retracted position in the event of any type of electrical failure, such as the failure of a relay.

The PLC controls operation of motor 326 through relays 334. Preferably, relays 334 are digitally activated relays that act to couple standard railroad crossing power lines to the motor. That is, the motor is compatible with the power supplied at pre-existing crossings, the pre-existing power lines/terminals are coupled to one or more of the relays 334, and the motor is activated when the PLC supplies a digital signal to the corresponding relay(s) which causes the supplied power to be coupled to the motor. To deactivate the motor, the PLC sends a different digital signal to the corresponding relay(s) to decouple the supplied power from the motor. The direction of motor operation (extension or retraction) may be controlled in a number of ways. In one implementation, the motor is responsive to a motor direction signal from the PLC such that activation of the motor through the relay(s) causes the motor to operate in the direction indicated by the motor direction signal.

As a failsafe feature, motor 326 is coupled to the telescopic arm through a clutch. In the event that power to the gate fails while the telescopic arm is extended, the clutch automatically disengages, allowing the telescopic arm to be manually retracted. Moreover, the clutch may be spring loaded so that in the event of a power failure, automatic disengagement of the clutch is followed by automatic retraction of the telescopic arm.

Interface 332 provides external access to the PLC for purposes of programming the PLC and downloading diagnostic information. Preferably, a laptop computer is coupled to the PLC via the interface and a programmer uses the laptop to install or modify the PLC program. Diagnostic information that can be downloaded from the PLC includes such information as frequency of motor usage and total motor usage.

Video memory 336 is provided to store video supplied by the gate video cameras. For example, video camera 322*b* mounted on the first arm member, video camera 322*c* mounted on the second arm member, and video camera 322*a* mounted atop the stanchion, supply video to the video memory directly or via the PLC (the couplings between the video cameras and the memory or PLC are not shown). The contents of the video memory may then be accessed through PLC 330 and interface 332. For example, a laptop computer or video display is coupled to interface 332 and video is transferred to the interface through the PLC.

Wireless link 338 is provided to pass data to/from the PLC and video memory. One possible use of the wireless link is programming the PLC. That is, a program may be transmitted to the link and, in turn, loaded into the PLC. Another possible use of the wireless link is coupling the gate video cameras to the video memory and PLC. For example, the cameras could be equipped with transceivers which respond to an on/off signal from the PLC through the link and which transmit video signals generated by the cameras to the video memory through the link. Still another possible use of the wireless link is transmitting video and/or diagnostic data to a remote monitoring station. In the case of transmitting video data, the data is passed from the video memory to the wireless link and then on to the remote station. In the case of transmitting diagnostic data, the data is passed from the PLC to the wireless link and then on to the remote station.

It is noted that, regardless of the type of data that is communicated over the wireless link, a preferred embodiment of the link is cell-phone type wireless link. It is further noted that it is possible to use a hardwired communication link, such as a land-line telephone link, in lieu of the wireless link.

Figure 11:
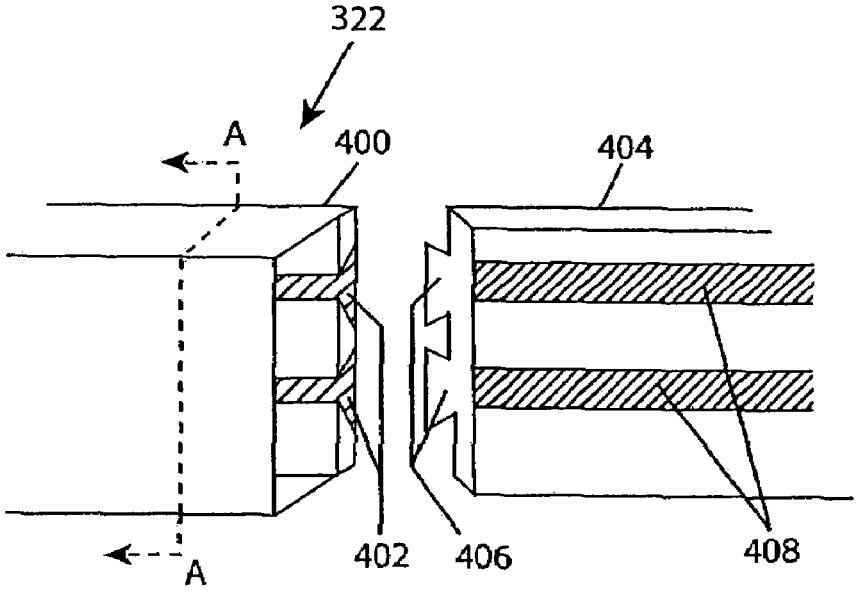
FIG. 11 is a perspective view showing a preferred embodiment for providing electrical conductors in a telescoping gate assembly according to the invention.
Figure 12:
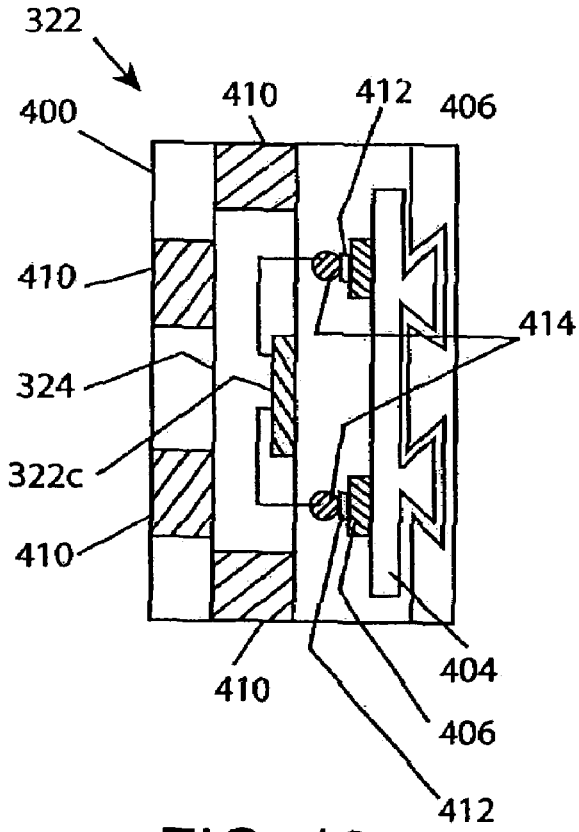
FIG. 12 is a cross-sectional view of a telescopic arm member of the invention employing the FIG. 11 configuration in accordance with the invention.

Referring now to FIGS. 11 and 12, there is shown a perspective view of a preferred embodiment for providing electrical power and/or signals to second arm member 324.

As can be seen from FIG. 11, the first arm member 322 includes a rectangular cross-section outer portion 400 that includes two extrusions 402 incorporated into one of its walls. A conductor modular unit 404 includes protrusions 406 which mate with extrusions 402 to mount the modular unit to the outer portion. The modular unit also includes two conductive strips 408 which are used to carry power and signals to electronic parts of second arm member 324.

FIG. 12 is a cross-sectional view of telescopic arm assembly 314 employing the FIG. 11 configuration. The cross-section is taken along line A-A (shown in FIG. 11). As can be seen in FIG. 12, the outer portion of first arm member 322 houses the second arm member 324 and modular unit 404. The modular unit is positioned to the right in FIG. 12. The modular unit's conductive strips are contacted by brushes 412 which are mechanically coupled to the second arm member and electrically coupled to light 322*c*. The conductive strips serve as the power terminals for light 322*c*. Preferably, the holding unit takes the form of copper conductive strips set in a plastic base material. The brushes are preferably made of a copper and bronze alloy.

Also shown in FIG. 12 are springs 414 and bearings 410. The springs maintain positive contact between the brushes and the conductive strips. The bearings position the second arm member within the first arm member while allowing for longitudinal movement of the second arm member within the first arm member. Regarding the bearings, one or more of the bearings may take the form of a solid block of material that is structurally stable yet allows the second arm member to slide freely in a longitudinal direction relative to the first arm member. Alternatively, one or more of the bearings may take the form of a roller bearing. The preferred roller bearing configuration has rollers made of acetel, with the rollers arranged in roller mill type pairs to help eject foreign matter from the bearing. Acetel is the preferred material because it is hard but allows for sliding in the event that one or more rollers lock up. Moreover, Acetel does not significantly expand or contract in response to varying weather conditions, thereby providing dimensional stability.

Figure 13:
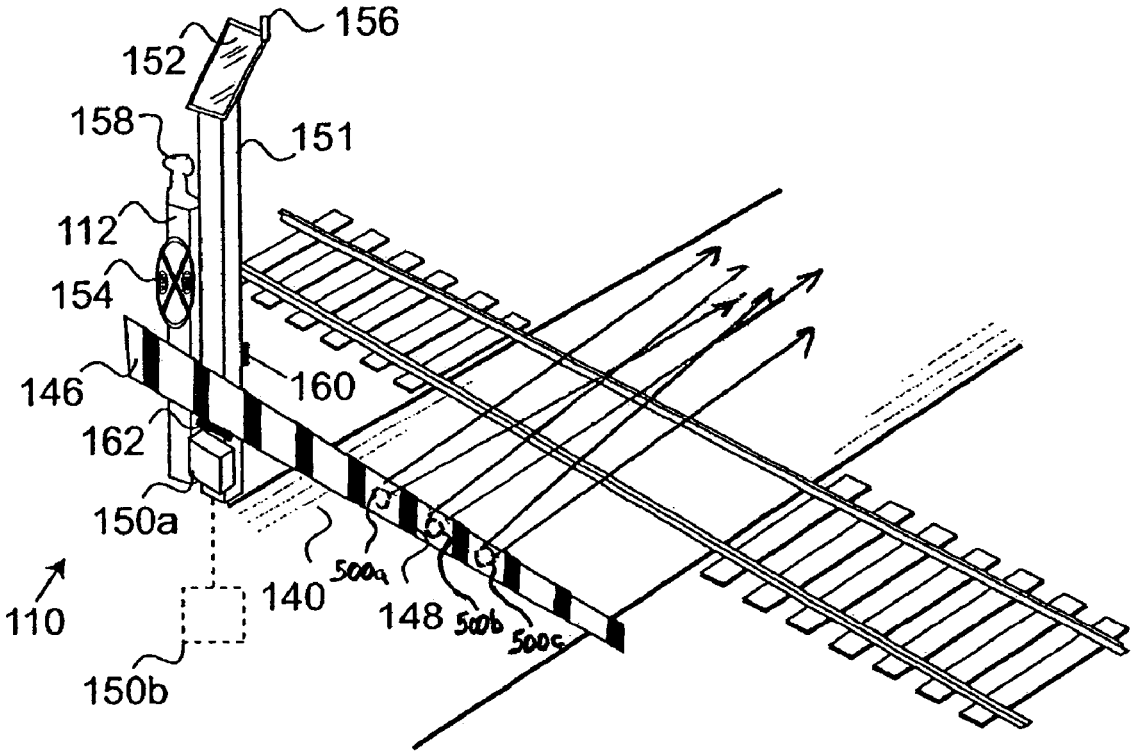
FIG. 13 is a perspective view of a railroad grade crossing assembly of the invention including sensors for detecting the presence of foreign bodies in the crossing area.

Referring now to FIG. 13, there is shown a further embodiment of a railroad grade crossing assembly in accordance with the invention. The FIG. 13 embodiment features three sensors 500*a*, 500*b* and 500*c* for detecting the presence of foreign bodies in the crossing area. As can be seen from the figure, sensors 500*a-c* are positioned on inner gate 148 and oriented toward the railroad grade. Preferably, the detectors are sonic, radar or infrared type detectors, or some combination of sonic, radar and infrared type detectors. Most preferably sonic detectors are used because they have been shown to perform acceptably in bad weather and in dirty environments.

The detectors may be operated as a sensor array, and as such, their sensitivity pattern may be electronically steered. For example, radar transceivers are used as sensors 500*a-c* and their signals are combined such that the sensors form a phased array radar system having an electronically steered beam. Such a beam could periodically sweep the crossing area in a "search mode" to detect foreign objects, and then be switched to a "tacking mode" upon detection of an object. In addition, the signals received by individual sensors may be weighted such that the resultant combined beam is narrowed, thereby providing greater detection accuracy.

The sensor configuration shown in FIG. 13 is illustrative. Several alternative configurations are possible. For instance, a single sensor could be employed in lieu of using multiple sensors, and if a multiple sensor configuration is used, it does not have to be limited to three sensors, any number of sensors may be employed. Regarding sensor positioning, the sensors could be positioned on the outer gate 146 rather than on the inner gate 148. Or, some sensors could be positioned on the outer gate while others are positioned on the inner gate.

In any event, when the sensor(s) detect a foreign presence in the crossing area, appropriate action is taken. In one implementation, when the sensors detect a foreign presence they generate a control signal that inhibits telescoping of the inner gate. In this manner, a significant portion of the roadway will be left open upon arrival of a train, allowing the foreign presence (e.g. a person or car) to evacuate the crossing area prior to the train's arrival.

In any of the foregoing embodiments, the railroad grade crossing assembly may be set up such that the telescoping action of the inner/second arm member is not a full telescoping action. That is, the amount of telescoping movement can be adjusted to any amount within the range of no-telescoping-movement to full-telescoping-movement. In this manner, the assembly could be adapted to the size of the roadway on which it is employed. Also, the assembly could be adapted to compensate for incorrect placement of stanchions, or to compensate for non-customary stanchion positioning. Moreover, when less than complete closure of a roadway is desirable, the assembly can be adjusted to partially close the roadway to the desired degree. Of course, minimum closure will be determined by the size of the gate in it's zero-telescoping state.

One way to control the amount of telescoping is through the motor that actuates the inner/second arm. For instance, motor 30 of FIG. 3, motor 58 of FIG. 4, or motor 326 of FIG. 9 can be electronically switched such that the corresponding inner/second arm does not fully telescope or does not telescope at all. In the case of the FIG. 9 embodiment, the amount of telescoping could be programmed into PLC 330.

It should be noted that traffic at a railroad grade crossing can be managed by employing a single crossing assembly according to any of the foregoing embodiments, or by employing more than one crossing assembly according to any of the foregoing embodiments. In one example, two crossing assemblies like the assembly shown in FIG. 7 are installed at a single crossing. In another example, one assembly like the assembly of FIG. 3 and one assembly like the assembly of FIG. 9 are be installed at a single crossing. When multiple assemblies of the invention are employed at a crossing they may be configured to completely or partially close one side of the crossing, completely close both sides of the crossing, completely close one side of the crossing and partially close the other side, or partially close both sides of the crossing. Moreover, three or four crossing assemblies may be employed at a crossing to achieve the desired closure.

Although the invention has been particularly shown and described with reference to certain preferred embodiments, it will be readily appreciated by those of ordinary skill in the art that various changes and modifications may be made therein without departing from the spirit and scope of the invention. It is intended that the appended claims be interpreted as including the foregoing as well various other such changes and modifications.

What is claimed is:

1. A railroad grade crossing assembly for inhibiting access to a railroad crossing area, comprising:

gate means connectable to a stanchion and movable between a generally upright position to permit access across the railroad crossing and generally horizontal position for inhibiting access across the railroad crossing, further comprising telescopic arm means incorporated into said gate means and being operable to selectively extend and retract from said gate means crossing assembly in response to a control signal;

one or more sensors operable to detect the presence of a foreign body in said crossing area and providing a corresponding sensor signal comprising at least one of a leveling switch signal, a railroad crossing system signal, a bump switch signal, a listening device signal, a 45° gate angle detection signal, a time delay before gate extension retry signal, an extension attempt counter signal, an electrical failure detect signal, a sonic object detector signal, an IR object detect signal, and a radar object detect signal; and a programmable controller including a selectively programmable logic, providing said control signal in selective response to said one or more sensor signal according to said programmable logic to cause said telescopic arm to selectively extend and retract.

2. A railroad grade crossing assembly as recited in claim 1, wherein one or more sensors include a sonic sensor.

3. A railroad grade crossing assembly as recited in claim 1, wherein said one or more sensors include a radar sensor.

4. A railroad grade crossing assembly as recited in claim 1, wherein said one or more sensors include an infrared sensor.

5. A railroad grade crossing assembly as recited in claim 1, wherein said one or more sensors include at least two sensor types from the group consisting of sonic type sensors, radar type sensors and infrared type sensors.

6. A railroad grade crossing assembly as recited in claim 1, wherein said assembly includes a multiple of sensors and the corresponding sensor signal from each of said sensors are combined for detection purposes according to a programmed logic of said controller.

7. A railroad grade crossing assembly as recited in claim 1, wherein when said one or more said sensors detects the presence of a foreign body in said crossing area, said telescopic arm means is prohibited from extending from said gate means.

8. A railroad grade crossing assembly as recited in claim 1, wherein said telescopic arm means is operable to extend such that access across said crossing is completely blocked.

9. A railroad grade crossing assembly as recited in claim 1, wherein said telescopic arm means is operable to extend such that access across said crossing is only partially blocked.

10. A railroad grade crossing assembly for inhibiting access across a railroad crossing, comprising:

gate means connectable to a stanchion and movable between a generally upright position to permit access across the railroad crossing and a generally horizontal position for inhibiting access across the railroad crossing according to a gate control signal;

telescopic arm means movably incorporated within said gate means and being operable to extend from said gate means each time said crossing assembly is to inhibit access across said crossing and to retract each time said crossing assembly is not to inhibit access across said crossing according to an arm control signal; and a programmable controller providing said gate control signal and said arm control signal in response to one or more object detection sensor signal and a selectively programmable logic to cause said telescopic arm to selectively extend and retract, said programmable controller further including remote communication means which provides a communication path between said programmable logic and a system separated from said programmable controller.

11. A railroad grade crossing assembly as recited in claim 10, further comprising one or more sensors operable to detect the presence of a foreign body in the proximity of said crossing.

12. A railroad grade crossing assembly as recited in claim 11, wherein one or more sensors include a sonic sensor.

13. A railroad grade crossing assembly as recited in claim 11, wherein said one or more sensors include an infrared sensor.

14. A railroad grade crossing assembly as recited in claim 11, wherein said one or more sensors include at least two sensors from the group consisting of sonic type sensors, radar type sensors and infrared type sensors.

15. A railroad grade crossing assembly as recited in claim 11, wherein said one or more sensors include at least two sensors types from the group consisting of sonic type sensors, radar types sensors and infrared type sensors.

16. A railroad grade crossing assembly as recited in claim 11, wherein said assembly includes a multiple of sensors and the signals from said sensors are combined for detection purposes.

17. A railroad grade crossing assembly as recited in claim 11, wherein when said one or more sensors detects the presence of a foreign body in the proximity of said crossing, said telescopic arm means is prohibited from extending from said gate means.

18. A railroad grade crossing assembly as recited in claim 10, wherein said telescopic arm means is operable to extend such that access across said crossing is completely blocked.

19. A railroad grade crossing assembly as recited in claim 10, wherein said telescopic arm means is operable to extend such that access across said crossing is only partially blocked.

20. A railroad grade crossing assembly as recited in claim 10, wherein said remote communication means comprises a wireless link.

21. A railroad grade crossing assembly as recited in claim 10, wherein said remote communication means comprises a hardwired communication link.

* * * * *